United States Patent [19]

Hata

[11] Patent Number: 4,891,635

[45] Date of Patent: Jan. 2, 1990

[54] ELECTROSTATIC DISPLAY ELEMENT

[75] Inventor: Kazuo Hata, Kakogawa, Japan

[73] Assignee: Daiwa Shinku Corp., Osaka, Japan

[21] Appl. No.: 328,813

[22] Filed: Mar. 22, 1989

Related U.S. Application Data

[63] Continuation of Ser. No. 88,692, Aug. 24, 1987, abandoned.

[30] Foreign Application Priority Data

Aug. 25, 1986 [JP] Japan ..... 61-129690

[51] Int. Cl.[4] ..... G09G 3/16

[52] U.S. Cl. ..... 340/783; 340/763; 340/815.27; 350/269

[58] Field of Search ..... 340/763, 783, 815.05, 340/815.20, 815.24, 815.27; 350/269, 266; 40/446, 447

[56] References Cited

U.S. PATENT DOCUMENTS

| | | | |
|---|---|---|---|
| 4,042,861 | 8/1977 | Yasuda et al. | 340/815.2 |
| 4,160,583 | 7/1979 | Ueda | 350/269 |
| 4,449,774 | 5/1984 | Takashi et al. | 339/59 M |
| 4,468,663 | 8/1984 | Kalt | 340/783 |
| 4,636,786 | 1/1987 | Haertling | 340/783 |
| 4,690,510 | 9/1987 | Takamatsu et al. | 350/334 |
| 4,747,670 | 5/1988 | Devio et al. | 340/763 |

*Primary Examiner*—Gerald Brigance
*Assistant Examiner*—Jeffery A. Brier
*Attorney, Agent, or Firm*—Koda & Androlia

[57] ABSTRACT

An electrostatic display element making use of electrostatic force acting between a movable electrode and a pair of fixed electrodes kept oppositely to each other with said movable electrode positioned therebetween. The movable electrode, which is made of a flexible film plated with thin metallic layers, is supported by a film holder consisting of two contact plates without using an electrically conductive adhesive for the purpose of preventing the movable electrode from being wrinkled owing to the use of the adhesive. To achieve a good electric contact between the movable elecrode and the film holder, at least one of said contact plates is made of electrically conductive elastomer.

4 Claims, 5 Drawing Sheets

ELECTROSTATIC DISPLAY ELEMENT

This is a continuation of application Ser. No. 088,692, filed Aug. 24, 1987 now abandoned.

BACKGROUND OF THE INVENTION

The present invention relates to an electrostatic display element for use in a display board of an electrostatic display apparatus, and more particularly to a support mechanism or expedient of a film-like movable electrode devised so as to be electrostatically attracted and repelled by a pair of fixed electrodes.

Electrostatic display elements operating based on the principle of electrostatic force acting on a movable electrode are disclosed, for example, in a U.S. Pat. No. 4,468,663 and a U.S. patent application Ser. No. 701,859. Their constitution and principle are very similar to those of the present invention. However, the purposes to which the above inventions are directed differ essentially from the objects of the present invention, so they are not mentioned further in this specification.

As is shown perspectively in FIG. 8 and cross-sectionally in FIG. 9, which reveals the cross-section taken along a line B—B in FIG. 8, a typical example of conventional electrostatic display elements is constituted fundamentally of a pair of fixed electrodes 1 and 2 facing each other and film-like movable electrode 3 positioned therebetween. The fixed electrodes 1 and 2 have their middle portions curved upwardly to form respective semicircular inwardly projecting protrusions 12 and 22. The fixed electrodes 1 and 2 are further coated with differently colored electrically insulating layer 15 and 25 on their inside surfaces confronting each other. The above insulating layers 15 and 25, which are not shown in the perspective view (FIG. 8) for the simplicity of drawing, are differently colored. The movable electrode 3 is made of a flexible thin case film 31 plated on both surfaces with thin metallic layers 32 and 33, which make the movable electrode 3 mirror-faced. The metallic layers 32 and 33 are also omitted in the perspective view (FIG. 8) for the simplicity of drawing. The movable electrode 3 has its lower part associated with a lead plate 6 sticked thereto with an electrically conductive adhesive 7. The lower part of the movable electrode 3, including the electric lead plate 6, is kept between the fixed electrodes 1 and 2 at their lower flat partions 11 and 21, with spacers 41 and 42 interposed. The assembly is fastened by means of screw bolts 71 and 72. In the clearance made between the spacers 41 and 42, an electrically conductive paste 7 is deposited on the lower end of movable electrode 3 for the purpose of providing an electric connection between both the metal-plated surfaces 32 and 33 of the movable electrode 3. Further, the fixed electrodes 1, 2 and the electric lead plate 6 are shaped, at their lowermost parts, so as to form electric-terminal projections 14, 24 and 60.

In such a constitution of the electrostatic display element, the fixed electrode 1 and 2 are kept voltage-supplied therebetween, while the movable electrode 3 is switched selectively to either of the fixed electrodes 1 and 2. Switched to the fixed electrode 2, as is schematically shown in FIG. 10, the movable electrode 3 is attracted by and to the fixed electrode 1 (and repelled by and from the fixed electrode 2) so as to mask the insulating layer 15 of the fixed electrode 1. If the switching is selected to the side of the fixed electrode 1, the movable electrode 3 comes, as is illustrated in FIG. 11, to mask the insulating layer 25 on the fixed electrode 2. Thus, the selected switching of the movable electrode 3 changes the appearance of the display element by making the movable electrode 3 mask or expose either of the colored insulating layers 15 and 25. Incidentaly, when one insulating layer (15 or 25) is masked, not only the other layer (25 or 15) is exposed but also its image is reflected by the confronting mirror-forming surface of the movable electrode 3.

To ensure a stable operation of the display element, however, such a conventional assembly as exemplified in FIGS. 8 and 9 has two important disadvantages as described in the following.

One of the disadvantages is due to the fact that an electrically conductive "adhesive" is used to provide a good electric connection between the movable electrode and the electric lead plate 6. The use of an adhesive is liable, as is easily conceived, to cause the film-like movable electrode 3 to be wrinkled longitudinally because of the same being thin and soft. The movable electrode 3, if wrinkled even slightly, has its flexibility deteriorated largely and comes to be awkward in responding to the electrostatic forces acting thereon. The other of the disadvantages is related to the electrically conductive "paste" 7 used for making electric connection between both the metallic layers 32 and 33 at the lower end of the movable electrode 3. If an electric connection is not made between the metallic layers 32 and 33 as in case of the movable electrode 3 shown in FIGS. 10 and 11, a rapid turning of the movable electrode 3 toward the fixed electrode 1 from the fixed electrode 2 can not be assured when the movable electrode 3 is switched to the fixed electrode 2 from the fixed electrode 1, because a smooth electric discharge is put under restraint owing to a double insulator construction by a core film 31 of the the movable electrode 3 and an insulating layer 25 on the fixed electrode 2, with the metallic layer 33 kept isolated. In this sense, the electric connection by means of the electrically conductive paste 7 is unreliable, firstly because the area of contact between the paste 7 and the metallic layers 32, 33 is very small and therefore, the contact has a peril of being broken when the paste is solidified, and secondly because the electric conduction of the paste is carried by the conductive particles suspended in a non-conductive medium and therefore, a high conductivity can not be expected when the paste is solidified.

OBJECTS AND SUMMARY OF THE INVENTION

The present invention aims at eliminating the above mentioned disadvantages from the electrostatic display element and makes it an object to provide an improved electrostatic display element free from an imperfect operation due to the wrinkles produced on the movable electrode.

Another object of the present invention is to provide an improved electrostatic display element having a movable electrode provided with reliable low-resistive electric connection between both its surfaces plated with metallic layers.

To achieve the above objects, the electrostatic display element according to the present invention has its movable electrode sandwiched, without using adhesive, in a film holder consisting of two electrically conductive contact plates. At least one of the two contact plates is made of electrically conductive elastomer.

BRIEF DESCRIPTION OF THE DRAWINGS

In the following the present invention is further described in detail on reference to the accompanying drawings, in which:

FIG. 3(*b*) shows a perspective view illustrating the movable electrode supporting mechanism employed in the embodiment shown in FIG. 3(*a*);

DETAILED DESCRIPTION OF THE INVENTION

Figure 1:
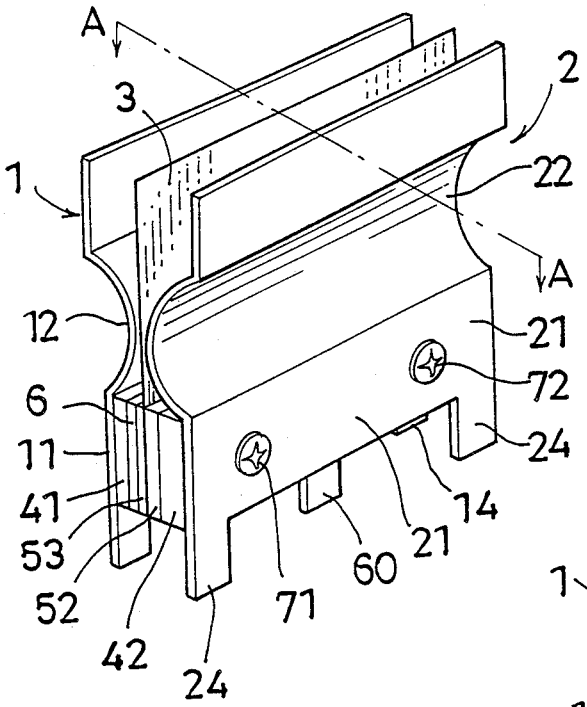
FIG. 1 shows a perspective view of an embodiment of the present invention.
Figure 2:
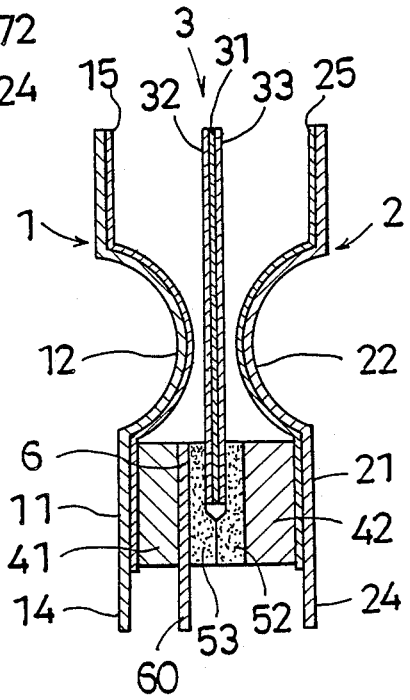
FIG. 2 shows the cross-sectional view taken along a line A—A of FIG. 1.
Figure 8:
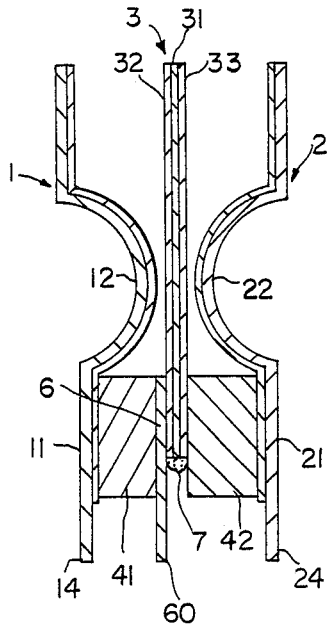
FIG. 8 PRIOR ART
FIG. 8 shows a cross-sectional view of the conventional element shown in FIG. 7.
Figure 7:
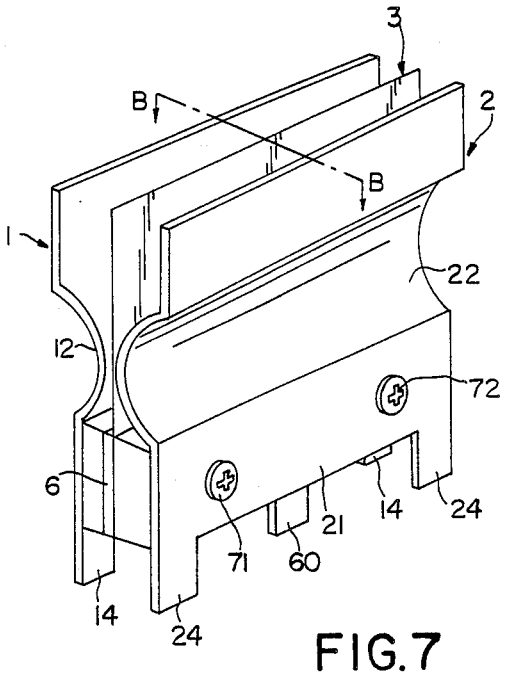
FIG. 7 PRIOR ART
FIG. 7 shows a perspective view of a conventional electrostatic display element.
Figure 9:
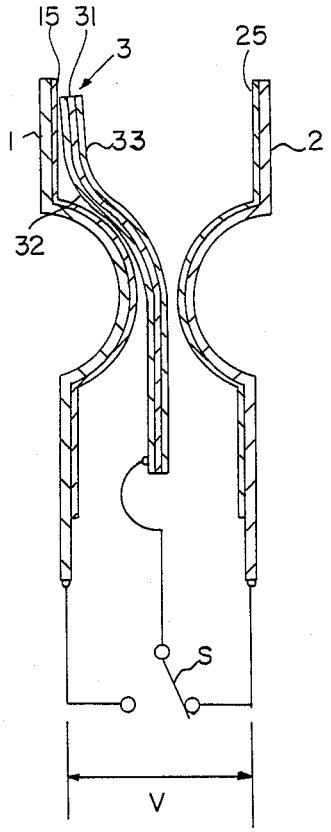
FIGS. 9 and 10 schematically illustrate the operational principle of the electrostatic display element.
Figure 10:
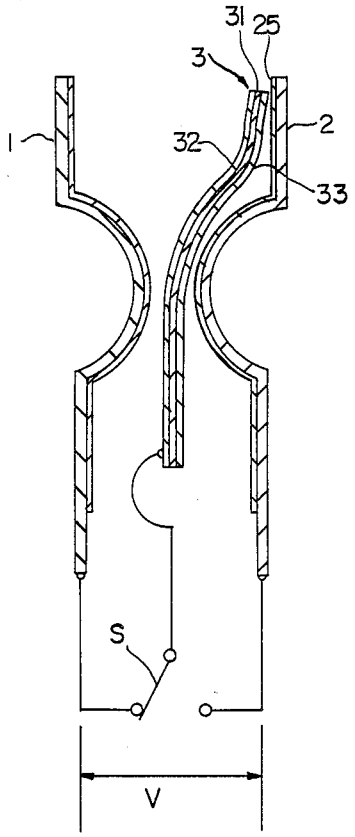

The constitution of an embodiment of the invention is shown perspectively in FIG. 1 and cross-sectionally in FIG. 2, which represents the cross-section taken along a line A—A of FIG. 1. In both FIGS. 1 and 2, all the constituents corresponding to those shown in FIGS. 7 and 8 are indicated with the same reference numbers as are employed in FIGS. 7 and 8. Referring to FIGS. 1 and 2, also this embodiment is fundamentally constituted of a pair of fixed electrodes 1 and 2 facing each other and a movable electrode 3 positioned between the fixed electrodes 1 and 2. The fixed electrodes 1 and 2 have their confronting surfaces coated with differently colored electrically insulating layers 15 and 25 respectively, and have their respective middle flank portions made to curve inwardly to form hemicylindrical inward protrusions 12 and 22. On the other hand the movable electrode 3 is made of a flexible thin film 31 plated on both surfaces with thin metallic layers 32 and 33, by which the movable electrode 3 is made mirror-faced. The partial constitution so far described above is essentially the same as that of the conventional element described previously on reference to FIGS. 7 and 8.

According to the present invention, however, the lower portion of the movable electrode 3 is not directly fixed to an electric lead plate 6 (which is the same as that shown in FIGS. 7 and 8), but firstly sandwiched in a film holder consisting of two contact plates 52 and 53 made of electrically conductive elastomer and then associated with the electric lead plate 6 with the contact plate 53 interposed. To assure a good contact for the lower parts of the contact plates 52 and 53, there is a clearance of 1.5 mm to 2.5 mm left under the lower end of the movable electrode 3. The electric lead plate 6 and the contact plates 52 and 53 putting the movable electrode 3 therebetween are secured, by screw bolts 71 and 72, between the lower flat portions 11 and 21 of the fixed electrodes 1 and 2 with electrically insulating spacers 41 and 42 interposed. With the above constitution around the lower part of the movable electrode 3, a low-resistive electric connection is made between the two metal-plated surface layers 32 and 33 of the fixed electrode 3 because of large-areal elastic contact among the movable electrode 3 and the electrically conductive elastomers 52 and 53. In addition, the elasticity of the elastomers 52 and 53 makes it possible to avoid the use of any adhesives or pastes at the contact portions.

In the following other modified embodiments of the present invention are described on reference to FIGS. 3(*a*), (*b*) to 7. In all of those drawings the colored insulating layers (15, 25) on the fixed electrodes (1, 2) and the thin metal layers (32, 33) plated on the movable electrode 3 are omitted for the simplicity of drawing.

Figure 3A:
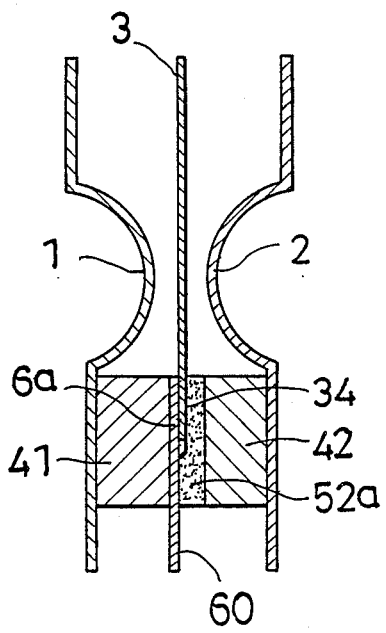
FIG. 3(*a*) shows a cross-sectional view of another embodiment of the present invention.
Figure 3B:
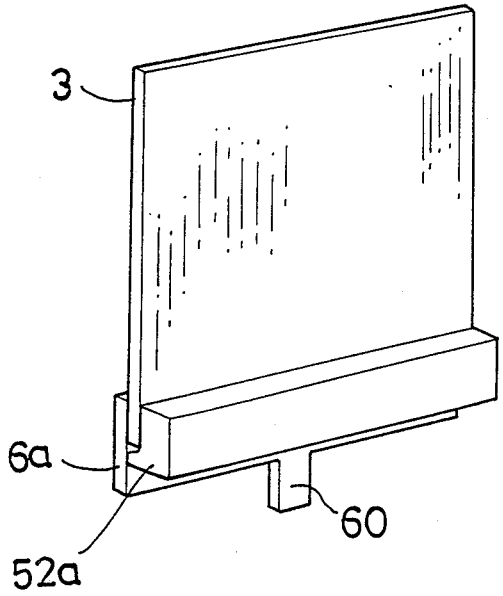

Referring to FIG. 3(*a*) which shows a cross-section of a modified embodiment of the present invention, the film holder consists of a contact plate 52*a* made of electrically conductive elastomer and a metal plate 6*a* which doubles as both the electric lead plate 6 and the contact plate 53 of FIG. 1. A partial assembly consisting of the movable electrode 3 and the film holder is perspectively shown in FIG. 3(*b*). As is distinctly shown in FIG. 3(*b*), the metal plate 6*a* has a projection 60 at the central lower end. The projection 60 plays a role of the terminal of the movable electrode 3.

Figure 4:
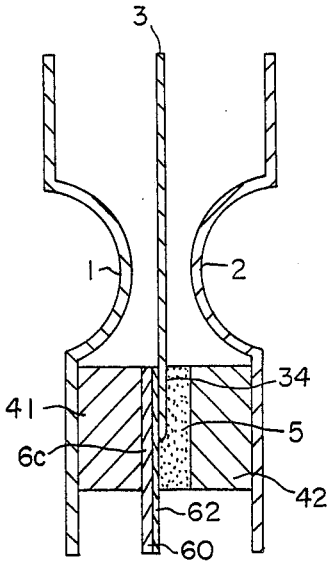
FIGS. 4 to 6 show cross-sectional view of further embodiments of the present invention.

A further modified embodiment is shown in FIG. 4. In this embodiment, the metal plate 6*a* used in the embodiment shown in FIG. 3 is replaced with an electrically insulating plate 6*c* plated with a thin metal layer 62 on the surface in contact with the movable electrode 3.

Figure 5:
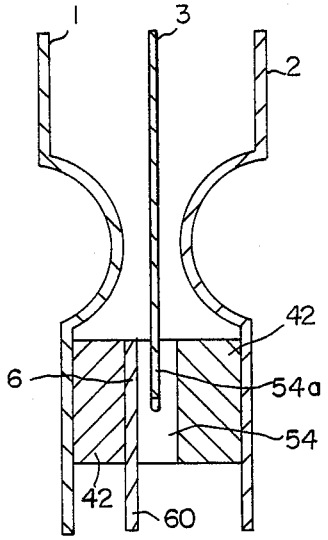

A still further modified embodiment is shown in FIG. 5. In this embodiment the film holder consists of one film holding block 54 made of electrically conductive elastomer. The film holding block 54 is provided with a film holding slot 54*a*, in which the lower part of the movable electrode 3 is securely inserted. The lead plate 6, which is the same as that shown in FIG. 2, is fixed to the side face of the film holding block 54. This embodiment has an advantage that, because of the one-body constitution of the film holder, not only the contact resistance appearing at the contact between two contact plates (such as 52 and 53 in FIG. 1) is eliminated but also the cost of manufacturing is reduced.

Figure 6:
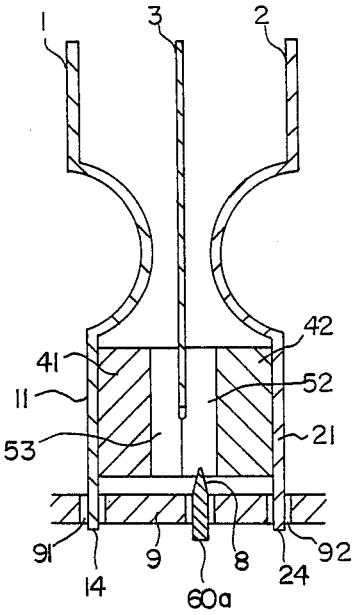

The above modified embodiments can further be modified as shown in FIG. 6. In this embodiment the movable electrode 3 has it lower part sandwiched, as in case of the embodiment shown in FIGS. 1 and 2, between two contact plates 52 and 53 made of electrically conductive elastomer, but the lead plate 6 (of FIGS. 1 and 2) is replaced with a contact pin 8 made to pierce the contact plate 52 or 53. The contact pin 8 is, in advance, provided on a circuit board 9 on which not only the wiring circuits to the electrostatic display element are printed but also the element is to be mounted. The lower end 60*a* of the contact pin 8 plays a role of the terminal 60 of the embodiment shown in FIGS. 1 and 2. Reference numerals 91 and 92 represent the through holes provided on the circuit board 9 for the purpose of receiving the fixed electrodes 1 and 2 at their lower ends 14 and 24 where the terminal circuits printed on the circuit board have electric connection with the fixed electrodes.

I claim:

1. An electrostatic display element operating under an electrostatic force produced by an electric voltage imposed between a pair of color-faced fixed electrodes and a bendable film-like electrode positioned between said color-faced fixed electrodes and made of a plastic film plated on both surfaces with a mirror-faced metallic layer, said electrostatic display element comprising:

a film holder for providing electric connection between both surfaces of said bendable electrode, said film holder consisting of two electrically conductiing contact plates made to contact respectively with both surfaces of said bendable electrode at its lower portion and extending downwardly over the lower end of said bendable electrode in order to come into contact with each other below the lower end of said bendable electrode, at least one of said electrically conducting contact plates being made of an electrically conducting elastomer, and said film holder being sandwiched between the lower portions of said color-faced fixed electrodes with electrically insulating spacers interposed; and an electric lead plate inserted between said film holder and one of said spacers so as to be in electrical connection with said film holder, said electric lead plate extending downwardly over the lower end of said film holder;

whereby said film-like bendable electrode not only has both its surfaces connected electrically but also is mechanically held so as to be free from wrinkles.

2. An electrostatic display element defined in claim 1, wherein both of said two electrically conducting contact plates are made of an electrically conducting elastomer.

3. An electrostatic display element defined in claim 1, wherein one of said two electrically conducting contact plates is made of a metallic plate, and said metallic plates also acts as said electric lead plate.

4. An electrostatic display element defined in claim 1, wherein one of said two electrically conducting contact plates is made of an electrically insulating plate plated with a metallic layer, and said electrically insulating plate plated with a metallic layer also acts as said electric lead plate.

* * * * *